United States Patent [19]

Cook

[11] Patent Number: 5,076,503

[45] Date of Patent: Dec. 31, 1991

[54] SIZE REDUCTION PROCESSING APPARATUS FOR SOLID MATERIAL

[76] Inventor: Robert L. Cook, 119 Church St., Lewisburg, Ky. 42256

[21] Appl. No.: 588,482

[22] Filed: Sep. 25, 1990

Related U.S. Application Data

[63] Continuation of Ser. No. 378,916, Jul. 12, 1989, abandoned.

[51] Int. Cl.[5] ..... B02C 18/18; B02C 23/12; B02C 23/14

[52] U.S. Cl. ..... 241/73; 83/349; 83/700; 144/163; 144/230; 241/792; 241/80; 241/93; 241/280

[58] Field of Search ..... 241/80, 92, 93, 73, 241/79.2, 280, 282.2, 97; 144/163, 172, 174, 176, 230; 83/349, 674, 700

[56] References Cited

U.S. PATENT DOCUMENTS

| | | | |
|---|---|---|---|
| 332,854 | 12/1885 | Woods | 241/282.2 |
| 1,076,714 | 10/1913 | Stanat | 83/700 X |
| 1,295,171 | 2/1919 | Hunter | 144/230 |
| 2,468,321 | 4/1949 | Bland | 241/80 X |
| 2,559,701 | 7/1951 | Becker | 241/280 X |
| 2,830,772 | 4/1958 | Martin | 241/280 |
| 3,039,503 | 6/1962 | Mainone | 144/230 |
| 3,322,175 | 5/1967 | Ward | 241/282.2 |
| 3,354,921 | 11/1967 | Elsner | 241/280 X |
| 3,679,143 | 7/1972 | Montgomery | 241/280 |
| 3,878,994 | 4/1975 | Tee | 241/80 X |
| 4,061,277 | 12/1977 | Whitney | 241/73 |
| 4,240,588 | 12/1980 | Fulghum, Jr. | 144/176 X |
| 4,241,881 | 12/1980 | Laumer | 241/73 X |
| 4,687,144 | 8/1987 | Irwin et al. | 241/80 X |
| 4,875,628 | 10/1989 | Knobloch et al. | 241/80 X |

FOREIGN PATENT DOCUMENTS

| | | | |
|---|---|---|---|
| 964827 | 5/1957 | Fed. Rep. of Germany | 144/172 |
| 2912218 | 10/1980 | Fed. Rep. of Germany | 241/280 |
| 1463484 | 3/1989 | U.S.S.R. | 144/172 |

*Primary Examiner*—Joseph M. Gorski

*Attorney, Agent, or Firm*—Fleit, Jacobson, Cohn, Price, Holman & Stern

[57] ABSTRACT

A cutter blade projects tangentially from the peripheral surface of a solid cylindrical rotor for travel along an arcuate path in converging relation to a support surface of an anvil aligned with a horizontal travel path along which scrap lumber is continuously fed by an infeed roller into a cutting zone formed between the anvil support surface and the peripheral surface of the rotor. Oversized solids emerging from the cutting zone below the rotor are separated from a wood chip product of desired size and recirculated to the infeed roller.

4 Claims, 2 Drawing Sheets

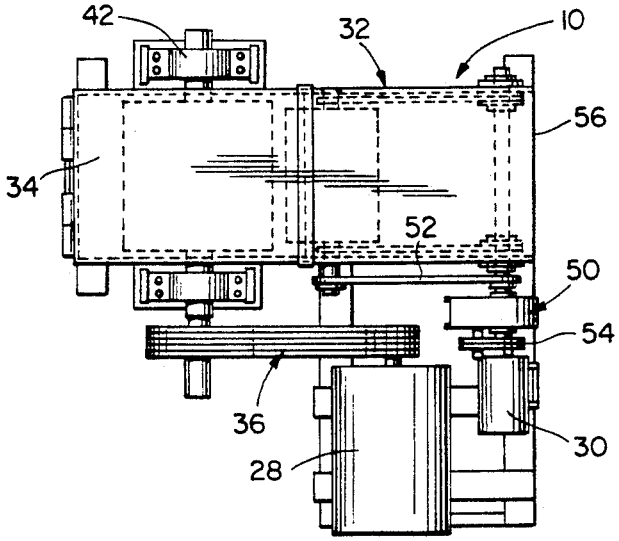
FIG. 1
FIG. 2
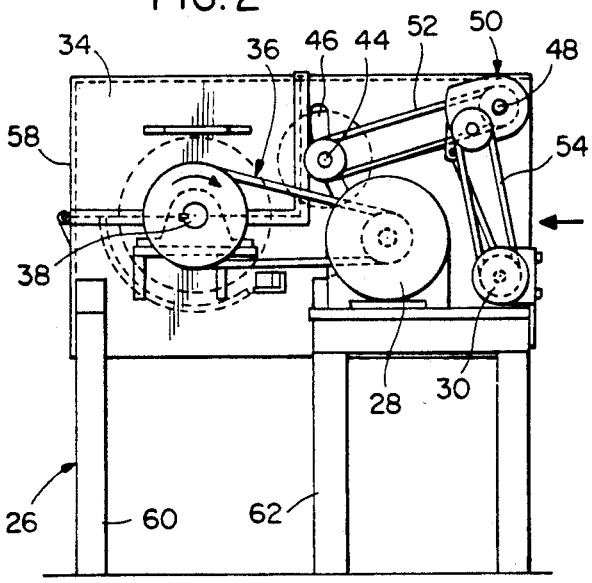
FIG. 3
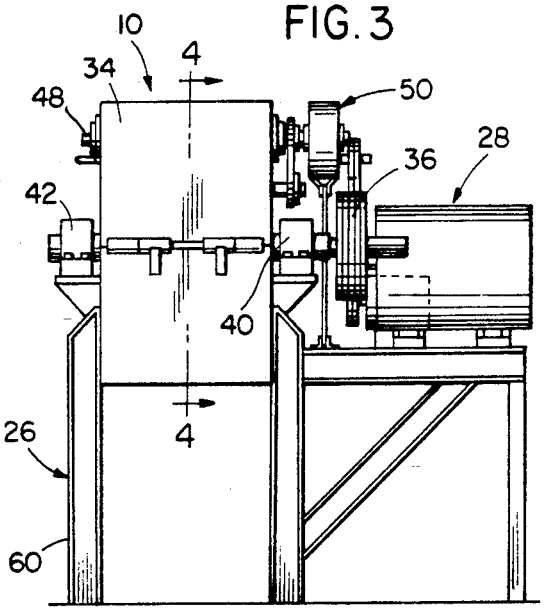
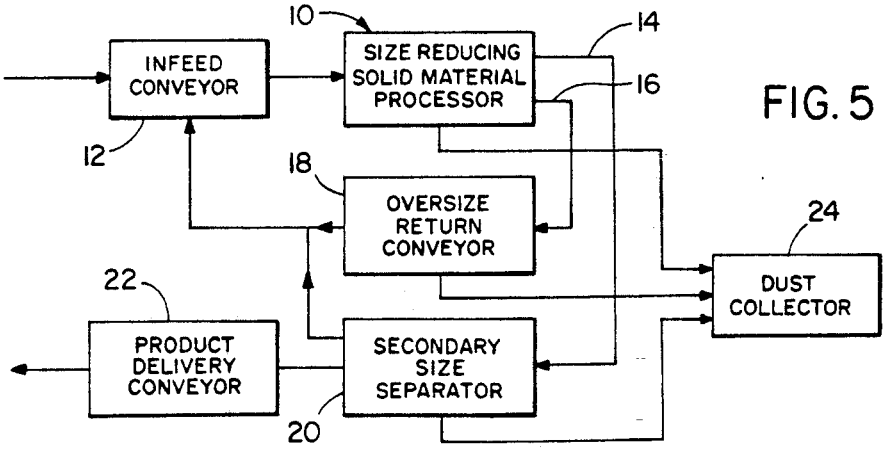
FIG. 5

SIZE REDUCTION PROCESSING APPARATUS FOR SOLID MATERIAL

This application is a continuation of application Ser. No. 07/378,916, filed July 12, 1989 and now abandoned.

BACKGROUND OF THE INVENTION

This invention relates generally to the processing of solid materials such as scrap lumber and wood chips and, more particularly, to the processing of waste products generated by wood manufacturing facilities in order to reduce such products in size suitable for commercial use in the production of paper, for example.

Scrap wood materials generated as a waste product in the manufacture of pallets, furniture, etc., are not suitable for commercial use unless reduced in size to a limited size range. Because of the wide dimensional range associated with such scrap wood materials, including for example small end cuts and scrap lumber, scrap wood cutters or chippers heretofore available were unsuitable in reducing such scrap wood materials to an acceptable size range of wood chips.

It is therefore an important object of the present invention to provide processing apparatus for reducing scrap wood materials to an acceptable size range of wood chips in an efficient and economical fashion.

SUMMARY OF THE INVENTION

In accordance with the present invention, scrap wood materials are continuously fed along a horizontal travel path by a feed roller from which material contacting projections extend. Such feed roller is gravitationally biased into yieldable contact with infeed materials by suspension from a pivoted lever arm, the feed roller being powered to continue feed of the materials at a calibrated infeed rate. A solid cylindrical rotor or drum is operatively positioned in spaced relation to the horizontal surface of an anvil aligned with the aforementioned horizontal infeed travel path in order to form therewith a converging cutting zone. A cutting action occurs within the cutting zone by virtue of a cutter blade carried on the rotor having a knife edge portion engaging and continuing the positive displacement of the infeed materials so as to reduce the infeed material in size. Toward that end, the cutting zone provides minimum clearance between the forward edge of the anvil surface and the arcuate path of the knife edge portion of the cutter blade, by adjustable positioning of the cutter blade in the rotor from which it projects. The size of the wood chips produced by the cutting action within the cutting zone, may be varied in size to fit individual customer needs by adjustment of the infeed rate of the wood materials, the rotational speed of the blade carrying rotor, and the minimum clearance between the cutter path and anvil surface within a limited clearance range. The geometrical relationships involved, the pivotal mounting of the feed roller and the solid cylindrical construction of the blade carrying rotor enables the apparatus to produce wood chips within a desirable size range despite the acceptance of infeed material within a relatively wide dimensional range. The relatively massive type of rotor in combination with the aforementioned features of the processing apparatus enables the cutting action to be performed with reduced input power because of high momentum impact forces exerted on the infeed materials through the cutter blade at periodically spaced intermittent intervals during rotation of the rotor.

According to other aspects of the invention, the cylindrical surface of the blade carrying rotor is provided with two pockets located forwardly of two cutter blades in the direction of rotation and in 180° angular spaced relationship to each other. Such pockets accommodate reception of infeed materials and cut wood chips to minimize heat buildup as well as to displace oversize wood chips emerging from the cutting zone into a separation zone located below the rotor. Such separation zone is located above a grid screen through which a primary size separating function occurs. Cut wood chips within a desired size range will accordingly drop through the grid screen to a delivery conveyor while the oversized wood chips will engage the rotor within the aforementioned pockets and be delivered to a return conveyor through which the oversize wood chips are recirculated to an infeed conveyor for delivery with infeed materials to the feed roller aforementioned. Similarly, oversize chips which pass through the primary separating screen grid may be sorted out by a secondary sorting mechanism for recirculation to the infeed conveyor.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

FIG. 1 is a top plan view of a processing machine constructed in accordance with one embodiment of the present invention.

FIG. 2 is a side elevation view of the machine shown in FIG. 1.

FIG. 3 is an end elevation view of the machine shown in FIGS. 1 and 2.

FIG. 5 is a block diagram schematically illustrating the size reduction processing system with which the machine of FIGS. 1–4 is associated.

DETAILED DESCRIPTION OF PREFERRED EMBODIMENT

Figure 4:
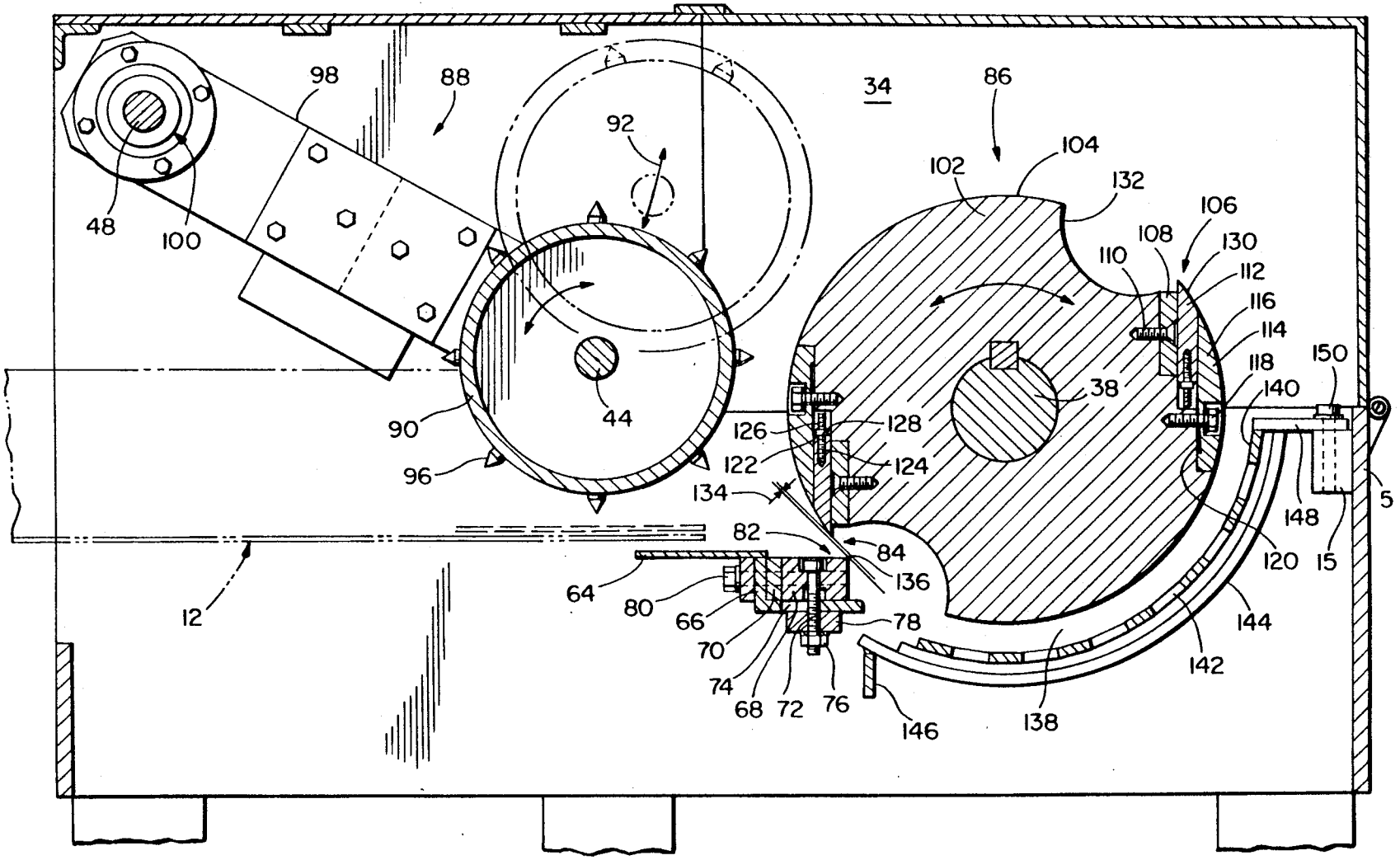
FIG. 4 is an enlarged section view taken substantially through a plane indicated by section line 4—4 in FIG. 3.

Referring now to the drawings in detail, FIGS. 1–4 illustrate a size reduction processing machine, generally referred to by reference numeral 10, constructed in accordance with one embodiment of the present invention. Solid materials are fed into the processing machine 10, in the form of scrap lumber and wood chips, by means of a vertically vibrating infeed conveyor 12 as diagrammed in FIG. 5. The processing machine in addition to performing a size reducing function to deliver solid particles within a predetermined size range as represented by output line 14 in FIG. 5, also performs a primary size separating function to deliver oversize solid particles through delivery line 16 to an oversize return conveyor 18. The size reduced solid particles pass through a secondary size separator 20 from which acceptable size reduced solid particles or wood chips emerge for delivery by a product conveyor 22. Oversize solid particles from both the oversize return conveyor 18 and the secondary size separator 20, are recirculated to the infeed conveyor 12 as diagrammed in FIG. 5, while dust and wood fines from the processing machine 10, the oversize return conveyor 18 and the secondary size separator are delivered to a dust collector 24.

The processing machine 10 as shown in FIGS. 1-3, includes a supporting frame assembly generally referred to by reference numeral 26 on which a cutter drive motor 28 and an infeed drive motor 30 are mounted. An elongated housing 32 having a removable top cover 34 is also supported on the frame assembly 26 in spaced relationship to the drive motors 28 and 30. The drive motor 28 is drivingly connected through an endless belt drive assembly 36 to a rotor shaft 38 rotationally supported by bearing assemblies 40 and 42 on opposite longitudinal sides of housing 32 to establish a fixed rotational axis in parallel spaced relationship to a powered feed shaft 44, which is angularly displaceable along an arcuate path through a slot 46 formed in a side wall of housing 32 as shown in FIG. 2. The arcuate path established by slot 46 has a rotational center on a fixed axis parallel to the axis of the rotor shaft 38 extending through a shaft 48 of a speed reducer 50 mounted on the side wall of the housing 32 and drivingly connected to the feed shaft 44 through a chain and sprocket drive 52. The speed reducer 50 is drivingly connected to the infeed drive motor 30 through an endless belt or chain drive assembly 54 as more clearly seen in FIG. 2.

As a result of the foregoing drive arrangements between the drive motors 28 and 30 and the shafts 38 and 44, an adjusted drive ratio may be established between such shafts in order to obtain the desired size reducing action of the processing machine 10 within the housing 32 as will become apparent hereinafter. The solid materials to be processed by machine 10 are fed into an open longitudinal end 56 of the housing 32 opposite the longitudinal end closed by removable cover 34. The infeed conveyor 12 as hereinbefore referred to in connection with FIG. 5, is adapted to project into the open end 56 of the housing within which the solid materials are received for processing. The processed products delivered by the machine 10, on the other hand, exit from the housing between the legs 60 and 62 of the frame assembly 26, as more clearly seen in FIG. 2. Conveyors for delivery of the processed products may accordingly be inserted between the legs 60 and 62.

Referring now to FIG. 4, the vibrating infeed conveyor 12 as shown by dotted line, extends into the housing 32 through its open longitudinal end 56 in order to establish a generally horizontal travel path for the solid materials to be processed within the housing. Such infeed materials are accordingly deposited by the conveyor 12 onto a longitudinally overlapping and underlying plate 64 connected to a transversely extending L-shaped bracket 66 fixed to the housing. The bracket 66 mounts thereon a horizontal, transversely extending anvil member 68 having a suitably hardened horizontal surface 82 aligned with the horizontal travel path of the infeed materials. A spacer 70 is disposed between the anvil member 68 and the vertical portion of the bracket 66, while the anvil member itself is firmly secured to the bracket by threaded bolts 72 extending through an adjustment slot 74 in the bracket with a nut 76 threadedly mounted on the bolt in abutment with a clamp element 78 underlying the bracket. A horizontally extending threaded fastener 80 also holds the anvil member assembled on the bracket in underlying, spaced relationship to its hardened top horizontal surface 82 and is used for adjustment.

The infeed materials on the conveyor 12 are continuously and positively displaced into a converging cutting zone 84 formed between the anvil surface 82 and a powered size reducing cutter head assembly generally referred to by reference numeral 86 by means of an infeed mechanism generally referred to by reference 88 as shown in FIG. 4. The infeed mechanism 88 includes a feed roller 90 rotatably mounted by the roller shaft 44, aforementioned in connection with FIG. 2, for limited angular displacement along an arcuate path 92 established by the slot 46 in the side wall of the housing as aforementioned. By virtue of the aforementioned drive connection of shaft 44 to the feed motor 30, the feed roller 90 is rotated in a counter-clockwise direction as viewed in FIG. 4 in order to positively displace infeed materials by contact with projections 96, such projections extending from the periphery of the feed roller as shown. The feed roller and projections thereon are gravitationally biased into contact with the infeed materials by virtue of the pivotal mounting of the shaft 44 by lever arm 98 about the axis of shaft 48 fixed to the housing, the lever arm 98 being journaled on the shaft 48 by means of a bearing assembly 100 as shown in FIG. 4.

The cutter head assembly 86 includes a blade carrying rotor drum 102 having a generally cylindrical peripheral surface 104. The rotor is mounted by powered shaft 38 to which it is keyed for rotation in a counter clockwise direction as viewed in FIG. 4. The rotor 102 is of a cross-sectionally solid construction as shown so as to provide relatively massive support for a pair of cutter blade assemblies generally referred to by reference numeral 106, mounted within recessed portions of the cylindrical surface 104 of the rotor in 180° angular spaced relationship to each other. Each cutter blade assembly includes a wear plate 108 secured by a screw fastener 110 to the rotor body within an inner recess portion. Such bed plate 108 extends transversely parallel to the rotational axis of rotor shaft 38 and provides a supporting surface with which a cutter blade 112 is in adjustably slidable contact. A clamp member 114 having an outer surface 116 in flush relationship to the outer cylindrical surface 104 of the rotor is held in contact with the cutter blade 112 by means of a screw fastener 118. A relatively shallow recess 120 is formed in the rotor abutting undersurface of the clamp member 114 in order to establish a substantial clamping pressure on the cutter blade 112 with which the underside of the clamp member is in contact as shown. The cutter blade 112 has an inner end 122 from which a threaded element 124 projects into contact with the rotor body through a gap 126 in the recessed portion within which the cutter blade is received. An internally threaded nut element 128 is threadedly mounted on the threaded element 126 in abutment with the end 122 of the blade element for locking the blade in an adjusted position with (in the position as illustrated) its outer beveled knife edge portion 130 flush with the cylindrical surface 116 of the clamp member 114 and projecting generally tangentially from the cylindrical surface beyond the wear plate 108 in the direction of rotation of the rotor.

Each cutter blade assembly 106 has associated therewith a radially inwardly projecting pocket 132 which extends from the wear plate recess in the rotor body forwardly in the direction of rotation. Each of such pockets 132 will accordingly accommodate reception of infeed materials as its associated cutter blade assembly 106 approaches the cutting zone 84 during rotation of the rotor 102. Furthermore, each cutter blade assembly during rotation of the blade carrying rotor 102 will engage and cut infeed materials wedged against the anvil surface 82 by the outer surface of the rotor 102 including the inwardly extending arcuate surfaces of the pockets 132. During travel of the cutter blade 112 along its arcuate path established by rotation of the blade carrying rotor 102, the knife edge portion 130 thereof will approach and depart from a position of minimum clearance 134 at the forward edge 136 of the anvil surface 82. In accordance with one embodiment of the invention, the minimum clearance distance 134 is between 0.010 and 0.090 inches.

As a result of the foregoing arrangement and relationships between the infeed mechanism 88, the cutter assembly 86 and the speeds of the feed motor 30 and cutter motor 28, the solid wood infeed materials being processed in accordance with the present invention are unexpectedly reduced to a desired size range to an extent not heretofore thought possible. The size range of the solid particles is furthermore selectively adjustable by corresponding adjustments of the drive motor speeds and limited adjustment of the minimum clearance dimension 134 as aforementioned.

With continued reference to FIG. 4, the size reduced solid particles emerging from the cutting zone 84 enter an arcuate separation zone 138 underlying the rotor 102. Oversized solid particles exceeding the desired size range undergo primary separation from the solid particles within the desired size range, with oversized particles being received within the pockets 132 and displaced by the pockets in response to rotation of the blade carrying rotor. Such displacement of oversize solids within the separation zone 138 is effected for collection thereof on an oversize return conveyor 18 as aforementioned in connection with FIG. 5. The separation zone 138 is defined by a grid screen 140 having openings 142 therein which are dimensioned to pass the solid particles within the desired size range. The grid screen is supported in its position radially spaced from the cylindrical surface of the rotor as shown, by a grid support 144. The grid support is fixedly mounted within the housing between a transversely extending anchor bar 146 and a grid clamp 148 secured by fasteners 150 to a mounting projection 152 extending from the end wall 58 of the housing. Solid particles within the desired reduced size range, will accordingly drop through the grid screen 140 onto a return conveyor through which such particles are delivered to a secondary size separator 20 as hereinbefore referred to in connection with FIG. 5.

It will be apparent from the foregoing description that the cutter blades 112 are readily adjustable for periodic repositioning as its knife edge portion 130 wears, without frequent replacement of the other parts of the cutter blade assembly such as the wear plate 108 and clamp member 114. Wear of the knife edge portion of the cutter blade assembly occurs as a result of the intermittent impact forces transmitted by such blade assemblies as they enter and pass through the cutting zone 84. The requisite impact forces are attained because of the relatively massive type of blade carrying rotor utilized, in accordance with the present invention. The outer cylindrical surface 104 of the rotor 102 also establishes the convergent cutting zone 84 from which the size reduced solid particles emerge at the forward edge 136 of the anvil surface 82 to affect the cutting action which is furthermore enhanced by the pocket formations 132 in the rotor body. Such pocket formations also accommodate primary size separation by receiving and displacing oversize solids through the separation zone 138 as hereinbefore described.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A machine for processing solid wood material to obtain therefrom solid particles of a reduced size, said machine comprising:

a housing, infeed means for continuous displacement of solid wood material along a substantially horizontal travel path extending into said housing, said infeed means including a vibrating conveyor and a rotating feed roller having projections thereon and means gravitationally biasing the feed roller for yieldable contact of the projections with the solid wood material on said vibrating conveyor during rotation of the feed roller, anvil means located in said housing for supporting the solid wood materials during cutting thereof within a cutting zone along the horizontal travel path, said anvil means having a forward edge and including a fixed support surface on which the solid wood material is supported within the cutting zone, said fixed support surface vertically underlying said vibrating conveyor, a cutter blade, carrier means including a solid cylindrical rotor having a generally cylindrical peripheral surface portion and rotatably mounted in said housing and mounting the cutter blade tangentially with respect to the generally cylindrical peripheral surface portion for travel through said cutting zone, said carrier means further including a wear plate secured to the solid cylindrical rotor, means for adjustably positioning the cutter blade on the wear plate with a knife edge portion of said cutter blade projecting therefrom and clamp means coextensive with said generally cylindrical peripheral surface portion of the rotor for locking the cutter blade in adjusted position on the wear plate, said means for adjustably positioning said cutter blade including a threaded element projecting from and extending into an end of said blade opposite to an end having said knife edge portion with said threaded element abutting against said solid cylindrical rotor, and an internally threaded nut element threadedly mounted on said threaded element for locking said cutter blade in an adjusted position, said cutter blade being closely spaced from said forward edge with minimum clearance in the cutting zone to reduce the solid wood material in size by cutting thereof of solid wood material projecting into the cutting zone beyond said forward edge resulting in formation of solid wood particles, separator means including a curved grid screen extending from a point located below the cutting zone and the infeed means to a point located downstream of and vertically above the cutting zone and the infeed means for separating and removing from said housing solid wood particles emerging from the cutting zone of a size equal to and less than solid wood particles of a first predetermined reduced size by passage of solid wood particles of a size equal to and less than the first predetermined size through openings defied in said curved grid screen equal to the first predetermined reduced size, pocket means defined in the generally cylindrical peripheral portion of said carrier means for receiving and displacing the solid wood particles of a size greater than the solid wood particles of the first predetermined reduced size past the separator means, the cutter blade being located rearwardly of the pocket means in the direction of travel through the cutting zone, an oversize return conveyor separate from the carrier means, said oversize return conveyor receiving from the path of travel of the carrier means the solid wood particles of a size greater than the solid wood particles of the first predetermined size and recirculating to the infeed means upstream from the cutting zone the solid wood particles of a size greater than the solid wood particles of the first predetermined size after passage of the solid wood particles of a size greater than the solid wood particles of the first predetermined size beyond the separator means, and a secondary size separator receiving solid wood particles from said separator means of a size equal to and less than the solid wood particles of the first predetermined reduced size, said secondary size separator separating the solid wood particles according to a second predetermined reduced size and conveying some of the solid wood particles of a size equal to and less than the second predetermined size to a product delivery conveyor and conveying the remainder of the solid wood particles of a size greater than the second predetermined size to said oversize return conveyor for return to the cutting zone with the solid wood particles of a size greater than said first predetermined size.

2. The machine of claim 1 wherein said material is scrap lumber and the reduced size solids are wood chips.

3. The machine of claim 2 wherein said horizontal travel path is terminated at a location along the arcuate path of the cutter blade of minimum spacing from the horizontal travel path.

4. The machine of claim 3 wherein said minimum clearance is between 0.010 and 0.090 inches.

* * * * *